United States Patent [19]

Baus et al.

[11] Patent Number: 4,993,229

[45] Date of Patent: Feb. 19, 1991

[54] BOTTLED WATER COOLING UNIT

[75] Inventors: Wayne A. Baus, Elyria; Frederick W. Haushalter, Kenton, both of Ohio

[73] Assignee: Aqua-Form Inc., Elyria, Ohio

[21] Appl. No.: 531,102

[22] Filed: May 31, 1990

[51] Int. Cl.[5] ..... F25B 21/02

[52] U.S. Cl. ..... 62/3.64; 62/394; 62/396; 222/146.6

[58] Field of Search ..... 62/3.64, 394, 396; 222/146.6

[56] References Cited

U.S. PATENT DOCUMENTS

| | | | |
|---|---|---|---|
| 3,008,299 | 11/1961 | Sheckler | 62/3.64 |
| 3,088,289 | 5/1963 | Alex | 62/3.64 |
| 3,250,433 | 10/1966 | Christine et al. | 62/3.64 |
| 3,270,513 | 9/1966 | Ter Bush | 62/3.64 |
| 3,296,806 | 1/1967 | Gonzalez | 62/3.64 |
| 3,310,953 | 1/1967 | Rait | 62/3.64 |
| 3,327,485 | 6/1967 | Ter Bush | 62/3.64 |
| 3,368,359 | 2/1968 | English et al. | 62/3.64 |
| 4,311,017 | 1/1982 | Reed et al. | 62/3.64 |
| 4,474,015 | 10/1984 | Christmas et al. | 62/3.64 |
| 4,866,945 | 9/1989 | Bender et al. | 62/3.64 |

*Primary Examiner*—Lloyd L. King

[57] ABSTRACT

A method and apparatus adaptable for use with bottled water dispensing systems thermoelectrically cools the bottled water contained in a bottle which is positioned in a water receptacle within a housing. The bottled water cooling units include a heat sink having a plurality of fins, preferably of a corrugated configuration, secured to and extending outwardly from the first side of a base plate. At least one thermoelectric chip, being connectable to an electrical energy source and having a cold side and a hot side, is bonded to the second side of the base plate, wherein the cold side of the chip is in contact with the water receptacle to lower the temperature of the water contained in and flowing through the receptacle, and the hot side of the chip is in direct contact with the heat sink base plate. A fan is provided to circulate air through the plurality of fins of the heat sink. The cooling unit further includes a power supply capable of providing a current through the at least one thermoelectric chip, wherein the power supply is also preferably capable of converting 110 volts alternating current to 12 volts direct current. Finally, the cooling unit may include clamping means for clamping the heat sink and thermoelectric chip against the water receptacle to assure direct continued contact between the cold side of the at least one thermoelectric chip and the water receptacle.

18 Claims, 3 Drawing Sheets

BOTTLED WATER COOLING UNIT

BACKGROUND OF THE INVENTION

The present invention relates to water coolers and, more particularly, to a method of and an apparatus for cooling bottled water.

Bottled water is an attractive alternative to tap water and its use is widespread for many reasons. Bottled water dispensing units can dispense water at home, in the workplace, and in the marketplace for drinking, cooking, coffee, and other beverages without the need for a plumbed water supply. Bottled water supply units are often designed to occupy a minimum of floor or counter space. Recreational vehicle users and campers find bottled water to be a convenient water source while away from home or other plumbed water sources. Finally, bottled water often contains fewer contaminants and chemicals than ordinary tap water. The relative purity of bottled water makes it particularly useful in laboratory settings. However, the bottled water industry has long been challenged to find means for supplying water which has a temperature comparable to that of refrigerated water.

One existing conventional bottled water cooling systems and drinking water fountain cooling systems contains three fundamental parts which include an evaporator, a compressor, and a condenser. The evaporator or cold section allows pressurized refrigerant to expand, boil, and evaporate. During the change of state from a liquid to a gas, energy, in the form of heat, is absorbed. The compressor operates as a refrigerant pump and recompresses the gas into a liquid. The condenser expels the heat absorbed at the evaporator and the extra heat added by the compressor to the environment or ambient.

The refrigerants used in compression type refrigerated water dispensers have generated environmental concerns in that refrigerants are believed to be a factor in ozone layer deterioration, thereby making such systems unattractive from an environmental standpoint. Moreover, a compression refrigeration method such as this tends to have to be large in order to accommodate the three fundamental parts. Additionally, the pump action of the compressor creates intermittent, aggravating noise when it operates. Finally, maintenance problems result from the moving mechanical parts. Consequently, although many offices and workplaces enjoy the advantages and convenience of bottled water, a choice must often be made between a quiet atmosphere which necessitates room temperature water, and cold water which necessitates noise and maintenance. Also, compression refrigerated water coolers usually comprise a large stand-alone base or housing which requires much more space than a counter top bottled water dispensing system, which space may not be available in many settings.

One alternative that has been proposed to eliminate the problems of conventional refrigeration methods is to employ a thermoelectric cooling system, as disclosed in U.S. Pat. No. 3,008,299, issued to Sheckler on Nov. 14, 1961. The Sheckler reference discloses an adaptation of a thermoelectric cooling system to drinking water fountains of the bubbling type. In a thermoelectric cooling system, a cold junction exists where energy in the form of heat is absorbed by electrons as they pass from one semiconductor to another, thereby moving from a low energy state to a high energy state. A power supply provides the energy required to move the electrons through the system. A hot junction which is attached to a heat exchanger expels heat to the environment or ambient. While a thermoelectric cooling system for drinking water fountains which are hooked up to a plumbed water supply such as tap water is disclosed in the Sheckler reference, such a system has so far been unadaptable to bottled water units.

A characteristic of bottled water systems which has thus far prevented the adaptation of thermoelectric cooling supplies to existing bottled water systems is that they usually have a ceramic water receptacle. The difficulty has been in attaching a thermoelectric cooling system to a ceramic water receptacle in a manner which provides efficient cooling transfer. A further difficulty has been the difficulty of providing cooling means insertable within a previously defined area, which area is very limited.

One method that has been proposed in response to the size limitations is the utilization of a thermoelectric device wherein the heat sink is mounted externally. Such a device is disclosed in U.S. Pat. No. 3,310,953, issued to Rait on Mar. 28, 1967. However, important disadvantages of the Rait reference include inefficiency of cooling and excessive power consumption by the fan motor. Since the heat exchanger used in the Rait reference contacts only a portion of the bottom of the beverage container, there is inefficient transfer of heat from the beverage container to the external heat sink via the thermoelectric module. In addition, only a portion of the air moved by the fan moves through the fins of the heat exchanger, resulting in excessive power consumption by the fan motor. Finally, the external heat exchanger disclosed in Rait is excessively large and unduly expensive.

Another possible solution for providing cold liquids is disclosed in U.S. Pat. No. 3,250,433, issued to Christine et al on May 10, 1966. In the Christine et al reference, an entire liquid dispensing unit for dispensing cold liquids is constructed. However, the Christine et al reference is not proposed or adaptable for use with existing bottled water dispensing units. Hence, such a solution for cooling bottled water would be much more costly in that existing ceramic water receptacle units would have to be entirely replaced and users would be required to buy an entire new bottled water dispensing system in order to have cold water. Additionally, the design and configuration of the Christine et al reference precludes the use of a conventional bottle supplied by a bottled water supplier.

Consequently, it would be desirable to provide a bottled water supply cooling system which could cool bottled water to a temperature comparable to that of refrigerated water. It would also be desirable to provide a bottled water cooling system which would be adaptable for use with existing bottled water systems, including ceramic water receptacle systems. It would further be desirable to provide a bottled water cooling system which could operate from a standard 110 volt outlet and provide refrigeration without the use of refrigerants. Finally, it would be desirable to provide a bottled water cooling system utilizing an internal thermoelectric cooling system which would operate quietly and occupy a minimum of space.

SUMMARY OF THE INVENTION

The present invention meets these needs by providing a thermoelectric bottled water cooling system which is capable of cooling water to a low temperature of thirty-two degrees Fahrenheit, and is readily adaptable for use with existing bottled water units. The thermoelectric cooling system includes at least one thermoelectric chip having a cold side and a hot side, eliminating the need for a cold plate attached to the thermoelectric chip. The present invention also provides a method of manufacture of the bottled water cooling system herein.

The bottled water supply cooling unit of the present invention comprises; a bottled water dispensing system with a water release means such as a lever or a faucet attached to a water receptacle, the system having a water bottle containing water, the water bottle being positioned upside down in the water receptacle such that the water flows from the bottle, through the water receptacle, and out the water release means; a heat sink including a base plate, the base plate having a first side and a second side, and the heat sink further including a plurality of fins, most preferably corrugated fin, bonded to and extending outwardly from the first side of the base plate; at least one thermoelectric chip bonded to the second side of the base plate wherein the thermoelectric chip has a cold side, the cold side being in direct contact with the water receptacle to lower the temperature of the water flowing through the water receptacle and further has a hot side which is in direct contact with the heat sink, wherein the base plate is located between the at least one thermoelectric chip and the plurality of fins; a power supply capable of providing a current through the thermoelectric chip; and a fan, whereby (A) the heat sink collects heat from the hot side of the thermoelectric chip thereby allowing current to continue flowing through the thermoelectric chip and maintaining the cold side of the thermoelectric chip in a cold state to continue cooling the bottled water receptacle, and (B) the fan pulls the collected heat away from the heat sink to cool the heat sink thereby allowing the heat sink to continue collecting heat from the hot side of the at least one thermoelectric chip.

In a preferred embodiment of the present invention, the bottled water supply cooling unit further comprises clamping means for clamping the heat sink with the at least one thermoelectric chip bonded thereto, to the water receptacle to assure direct continued contact between the cold side of the thermoelectric chip and the water receptacle. Since the water contained in the bottle must pass through the water receptacle in order to reach the water release means or lever, the present invention provides a cooling unit which cools the water contained in the water receptacle. The temperature of the water contained in and flowing through the receptacle is significantly lowered so that when the water is released by the water release means, it has a temperature comparable to that of refrigerated water, and may reach a low temperature of 33 degrees Fahrenheit.

Although the present invention is adaptable for use with any existing bottled water dispensing system, it is particularly advantageous for use with bottled water dispensing systems having a ceramic or a plastic receptacle. Additionally, the heat sink base plate in a preferred embodiment of the bottled water supply cooling unit is copper. Further, a preferred bottled water supply cooling unit comprises two thermoelectric chips bonded to the second side of the base plate, wherein the preferred bonding method is soldering. Finally, in a preferred embodiment of the present invention the power supply of the bottled water supply cooling unit is capable of converting 110 volts alternating current to 12 volts direct current.

The present invention provides a method of manufacturing the bottled water supply cooling unit. Initially, a bottled water dispensing system is provided having a water release means such as a lever or a faucet attached to a water receptacle, the system having a water bottle containing water, the water bottle being positioned upside down in the receptacle such that the water flows from the bottle, through the receptacle, and out the water release means. A heat sink is designed including a base plate, the base plate having a first side and a second side, and the heat sink further including a plurality of fins, most preferably of the corrugated type, bonded to and extending outwardly from the first side of the base plate. At least one thermoelectric chip is bonded to the second side of the base plate wherein the thermoelectric chip has (A) a cold side which is in direct contact with the water receptacle to lower the temperature of the water contained in and flowing through the water receptacle and further has (B) a hot side which is in direct contact with the heat sink, wherein the base plate is located between the thermoelectric chip and the plurality of fins.

The method of manufacturing the bottled water supply unit also comprises the step of providing a current through the at least one thermoelectric chip. The method further comprises the step of providing a fan, whereby (A) the heat sink collects heat from the hot side of the at least one thermoelectric chip thereby allowing current to continue flowing through the thermoelectric chip and maintaining the cold side of the thermoelectric chip in a cold state so it may continue cooling the bottled water receptacle, and (B) the fan pulls the collected heat away from the heat sink to cool the heat sink thereby allowing the heat sink to continue collecting heat from the hot side of the thermoelectric chip.

In a preferred embodiment of the present invention, the method of manufacturing the bottled water supply unit may further comprise the step of clamping the heat sink having the at least one thermoelectric chip bonded thereto, to the water receptacle to assure direct continued contact between the cold side of the at least one thermoelectric chip and the water receptacle. The temperature of the water contained in and flowing through the receptacle is significantly lowered so that when the water is released by the water release means, it has a temperature comparable to that of refrigerated water, and may reach a low temperature of 33 degrees Fahrenheit.

In a preferred embodiment of the present invention, the water receptacle of the bottled water dispensing system provided is ceramic, thereby providing a cooling unit which is adaptable in existing bottled water systems, most of which are currently ceramic. Additionally, the heat sink base plate manufactured for a preferred embodiment of the bottled water supply cooling unit is copper, and the fin bonded thereto has a corrugated configuration. Further, in a preferred method of manufacturing the bottled water supply cooling unit, two thermoelectric chips are bonded to the second side of the base plate. Finally, in a preferred embodiment of the present invention the power supply provided in the method of manufacture is capable of converting 110 volts alternating current to 12 volts direct current.

The present invention may be further understood from the following description, the accompanying drawings, and the appended claims.

DETAILED DESCRIPTION OF THE INVENTION

The present invention relates to a thermoelectric cooling unit for bottled water dispensing systems which eliminates the need for a thermoelectric cold plate, thereby having improved cooling efficiency. The invention also includes a method of manufacturing the bottled water dispensing system cooling unit.

Figure 4:
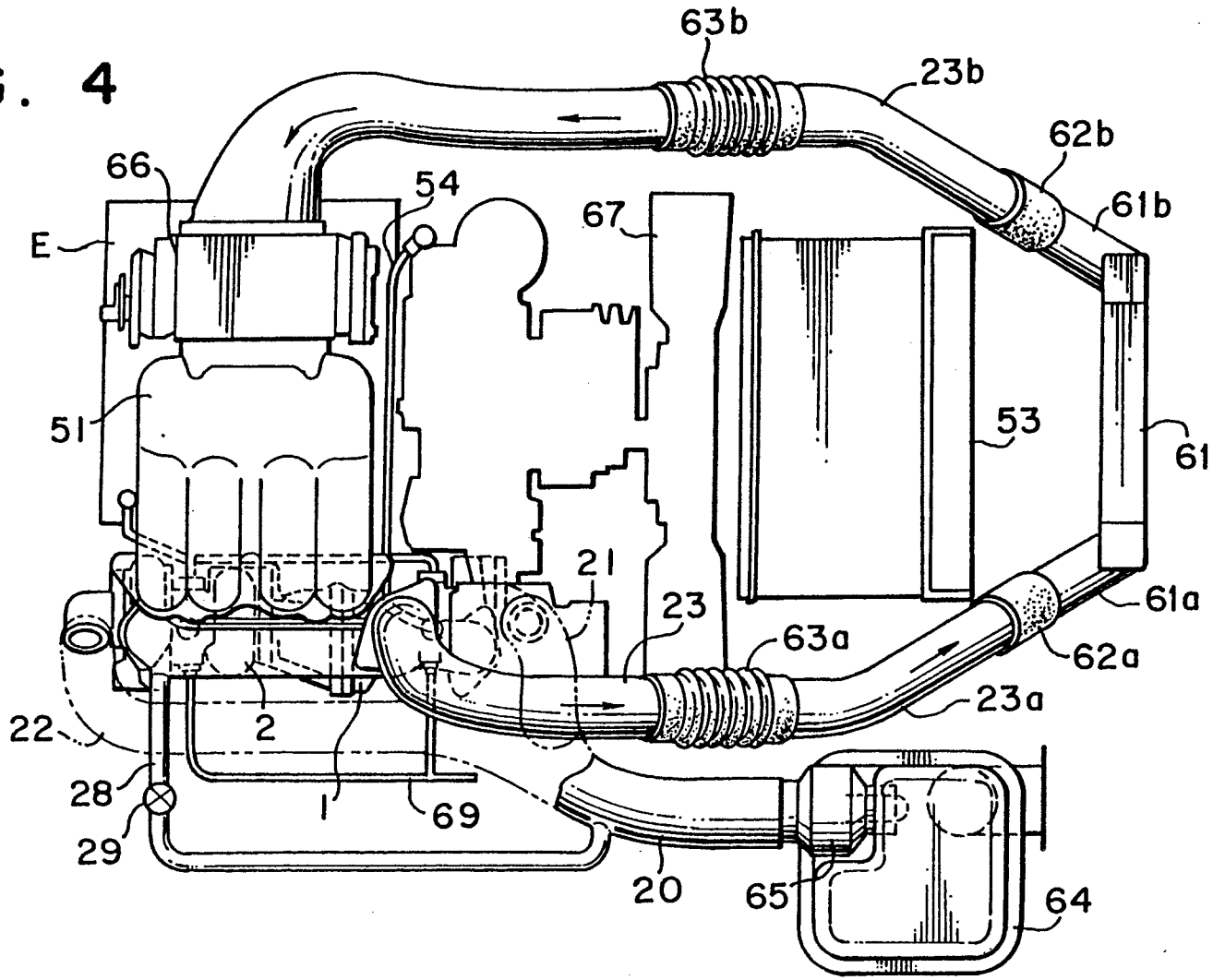
Figure 1:
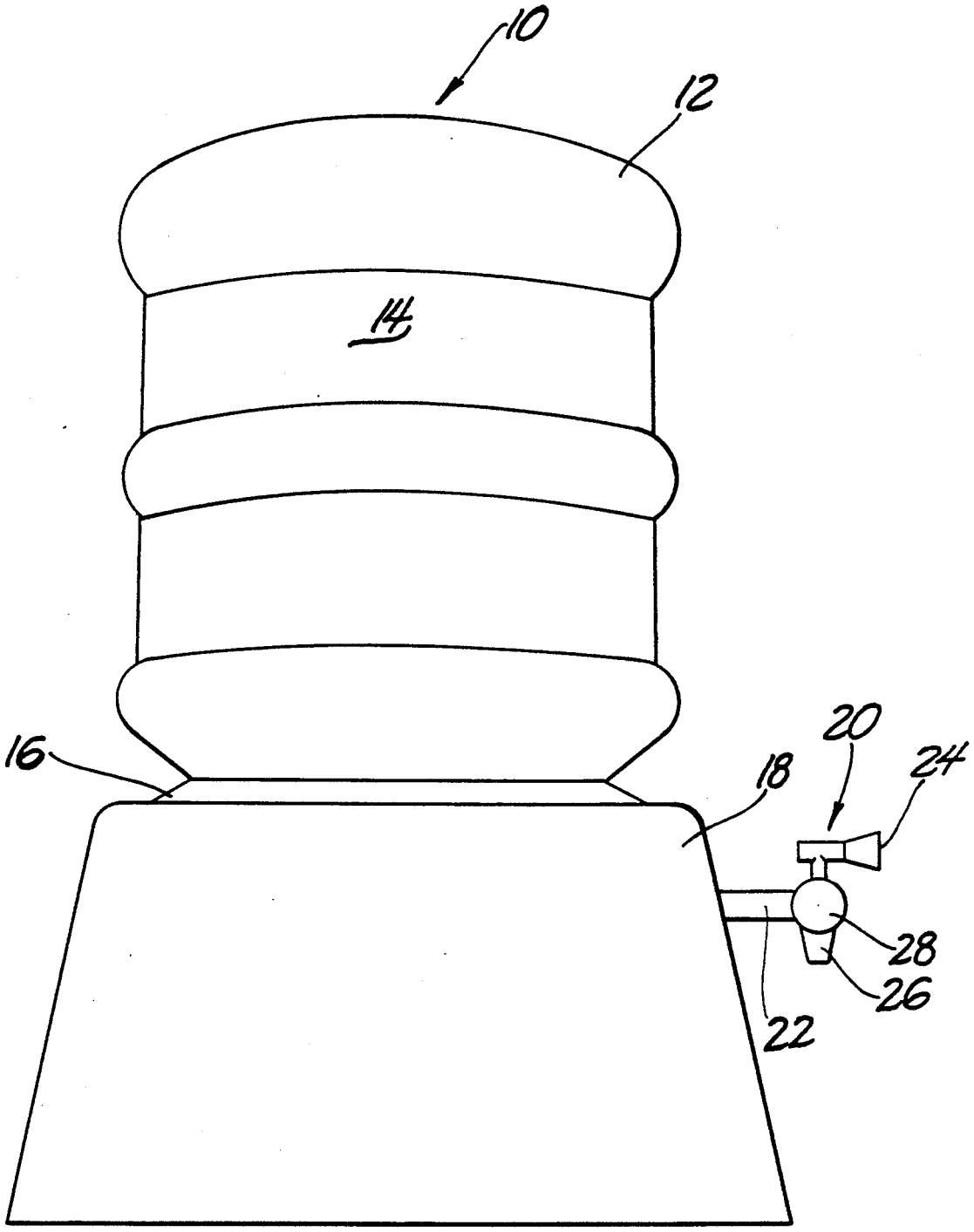
FIG. 1 is a side view of a typical bottled water dispensing system for use with the cooling unit of the present invention.

Referring now to FIG. 1, reference number 10 generally designates a typical bottled water dispensing system having a water bottle 12 having an opening and containing water 14. The water bottle 12 is positioned within a water receptacle 16, usually of a ceramic or plastic material and having an open top portion (not shown) for accepting the bottle 12. The water receptacle 16 is situated inside a hollow housing 18, and holds water for dispensing through a water release means 20. The hollow housing 18 has a top portion and a bottom portion and defines a first aperture in its top portion. Similarly, the water receptacle 16, situated within the housing 18 defines a second aperture corresponding to the first aperture, whereby the bottle 12 is positioned such that it extends through both the first aperture and the second aperture.

Figure 2:
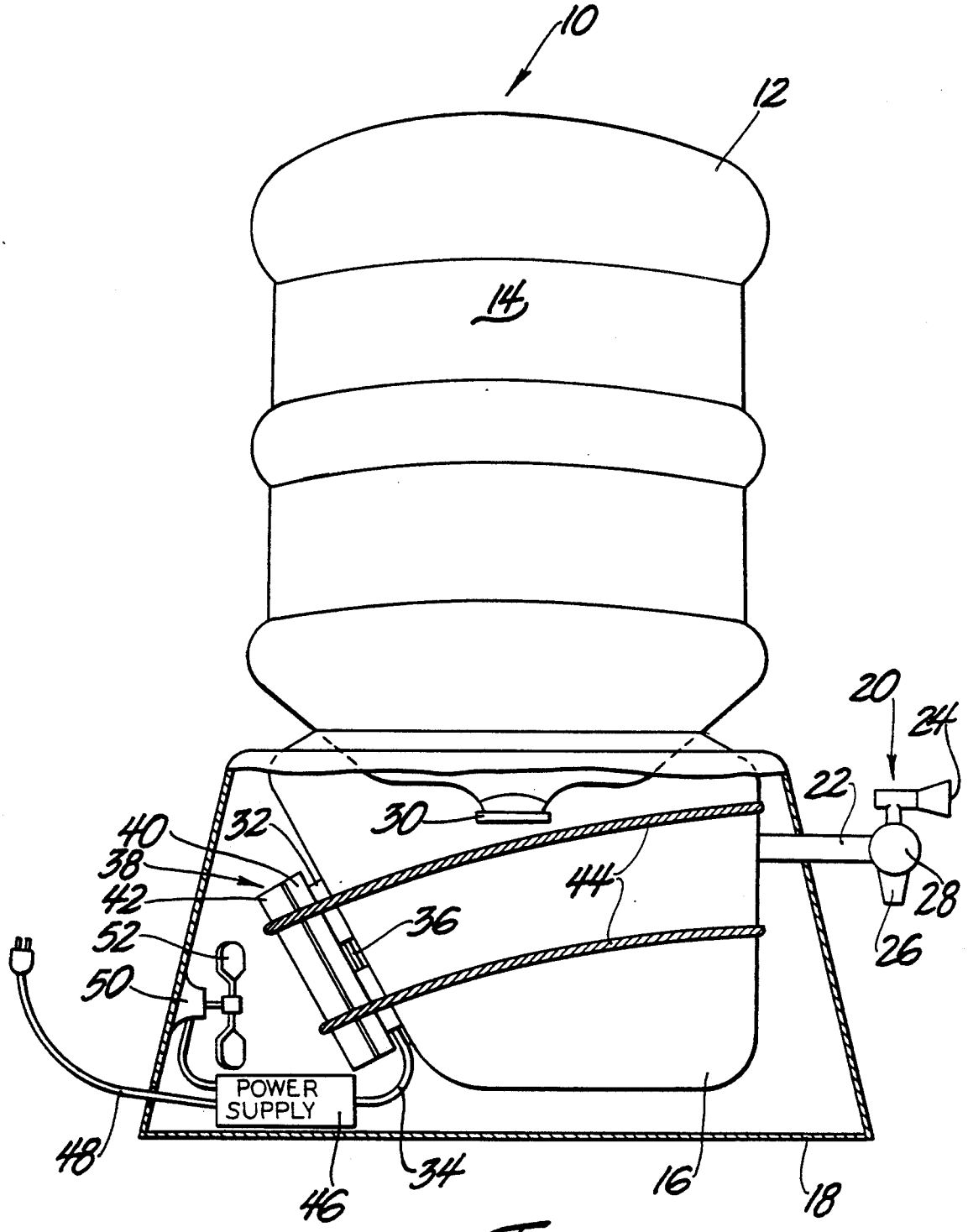
FIG. 2 is an enlarged sectional side view taken through the bottled water dispensing system of FIG. 1 with parts broken away to expose the cooling unit of the present invention.

In a preferred embodiment of the present invention, the water release means 20 is connected to the water receptacle 16 via a conduit 22, as best illustrated in FIG. 2. The conduit 22 is adapted to extend from the water receptacle 16 and through the housing 18 so that when a handle 24 is manually operated, cold water will flow out from the water receptacle 16, through the conduit 22, and down through the discharge spout 26. All of the elements of the water release means 20, including the conduit 22, the handle 24, and the discharge spout 26 are operatively associated with a faucet 28 as illustrated in FIG. 1.

Although the bottled water dispensing system 10 is illustrated as a counter top model, it will be understood that the cooling unit of the present invention is adaptable to a variety of bottled water dispensing system makes and models.

Referring now to FIG. 2, the side view of the bottled water dispensing system 10 of FIG. 1 is illustrated with one side cut away to expose the cooling unit apparatus of the present invention. FIG. 2 illustrates how the bottle 12 may be positioned within the water receptacle 16. It will be obvious to one of ordinary skill in the art that gravity will cause the water 14 to fill the water receptacle 16 once the bottle 12 has been positioned upside down with the bottle lip or opening 30 being open. When the handle 24 of the water release means 20 is positioned to permit the flow of water out through the discharge spout 26, the water 14 contained in the receptacle 16 will be released prior to the water 14 still contained in the bottle 12. Consequently, in a preferred embodiment of the present invention, the water 14 contained in the receptacle 16 is cooled to a lower temperature than the water 14 remaining in the bottle 12.

To achieve a cold water temperature of as low as 33 degrees Fahrenheit for the water 14 contained in the receptacle 16, at least one thermoelectric chip 32, connectable via line 34 to any suitable source of supply of electrical energy, is positioned within the housing 18 to contact the outside surface of the water receptacle 16. In a preferred embodiment of the present invention, a pair of thermoelectric chips 32 are connected in series via lead line 36. However, any suitable number of thermoelectric chips 32 may be used, limited only by the amount of usable area within the hollow housing 18.

Figure 3:
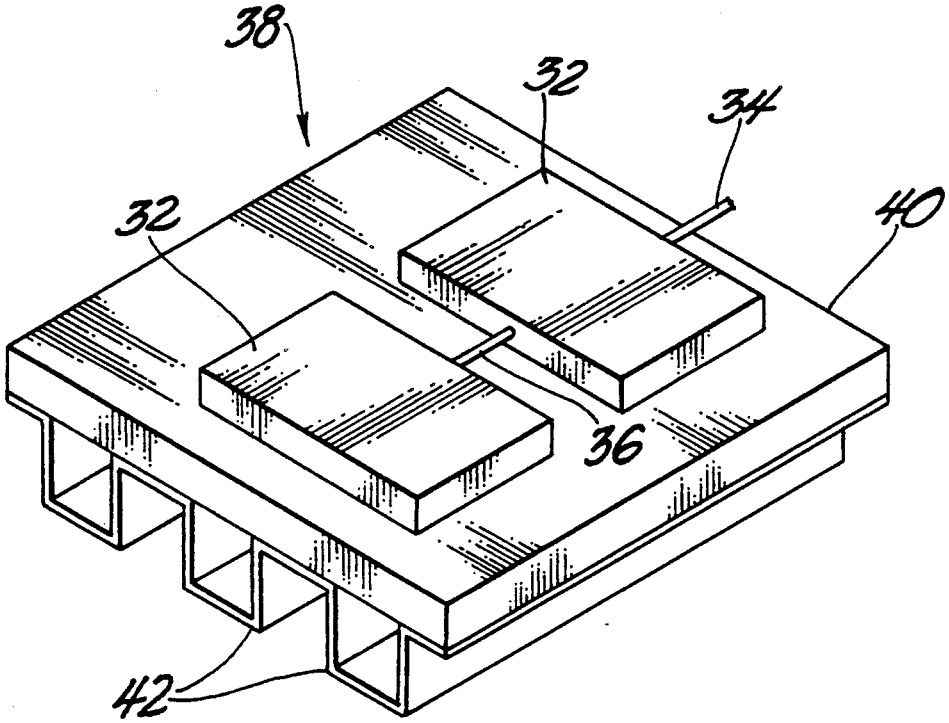
FIG. 3 is an enlarged end view of a pair of thermoelectric chips attached to a heat sink in accordance with the present invention.

The thermoelectric chip 32, as shown in FIG. 3, has a cold side which directly contacts a portion of the surface of the water receptacle 16, eliminating the extra attachment of a cold plate which is normally bonded to the chip, thereby improving the efficiency of the water cooling process. Opposite the cold side, each thermoelectric chip 32 used in the present invention has a hot side which is bonded or otherwise attached to a base plate 40 of a heat sink 38 consisting of the base plate 40 and a plurality of elongated, outwardly extending fins 42 suitably secured thereto, as best illustrated in FIG. 3. The base plate 40 may be any suitable material such as aluminum or copper, but preferably the latter, and the fin may be of any configuration, but preferably corrugated.

A preferred method for accomplishing direct, constant contact between the outside surface of the water receptacle 16 and the cold side of the thermoelectric chip 32 is to provide clamping means 44 which extend entirely around the water receptacle 16 such that the heat sink 38 and the thermoelectric chips 32 are securely attached thereto. The clamping means may be any suitable means, most preferably plastic or stainless steel straps.

In a preferred embodiment of the present invention, the electrical energy source to which the thermoelectric chips 32 are connected is a power supply 46, situated in the lower portion of the housing 18. The power supply 44 is capable of converting 110 volts alternating current to 12 volts direct current and supplying this current to the thermoelectric chips 32. For such a design, a suitable electric cable 48 may be plugged into a wall outlet as a means for providing the 110 volts of alternating current to be converted. Consequently, in a preferred embodiment of the present invention, the thermoelectric chips 32 are of a type that directly convert electricity so that a cooling effect is provided for the water 14 contained in the receptacle 16. However, it will be understood that the electrical energy source may be any of a variety of sources including self-contained batteries which may or may not be of the rechargeable type.

Suitable electrical connections are adapted to be provided between the various electrical components mounted in the housing 18, such as a motor 50 which drives or operates a fan 52 installed in the housing 18. The fan 52 circulates air through the plurality of fins 42, thereby cooling the heat sink 38 and the hot side of the thermoelectric chip 32 sufficiently to permit current to continue flowing through the at least one chip 32. This, in turn, maintains the cold side of each thermoelectric chip 32 in a cold state to continuously to generate coldness against the side of the water receptacle 16 thereby maintaining the water 14 contained therein at a cold temperature comparable to that of refrigerated water.

Having described the invention in detail and by reference to preferred embodiments thereof, it will be apparent that modifications and variations are possible without departing from the scope of the invention which is defined in the appended claims.

The embodiments of the invention in which an exclusive property or privilege is claimed are defined as follows:

1. A method of manufacturing a thermoelectric cooling unit for bottled water dispensing systems, comprising the steps of:

providing a bottled water dispensing system including, a hollow housing having a top portion and defining a first aperture in the top portion;

a water bottle containing water and having an opening insertable within the first aperture of the housing, a water receptacle positioned within the hollow housing and defining a second aperture corresponding to the first aperture, and a water release means attached to the water receptacle, whereby the opening of the water bottle is insertable in the first aperture of the housing such that the opening of the bottle extends through the second aperture of the water receptacle so that the water flows from the bottle, through the receptacle, and is released by the water release means;

installing a heat sink including a base plate, the base plate having a first side and a second side, and the heat sink further including a plurality of fins bonded to and extending outwardly from the first side of the base plate, the heat sink being installed in the housing;

applying a bonding process for bonding at least one thermoelectric chip to the second side of the base plate wherein the at least one thermoelectric chip has a cold side which is in direct contact with the water receptacle to lower the temperature of the water contained within and flowing through the water receptacle, and further has a hot side which is in direct contact with the heat sink, wherein the base plate is located between the at least one thermoelectric chip and the plurality of fins, the at least one thermoelectric chip being connectable to an electrical energy source;

mounting a power supply within the housing, the power supply being capable of providing a current through the at least one thermoelectric chip; and mounting a fan within the housing for circulating air between the plurality of fins of the heat sink whereby (A) the heat sink collects heat from the hot side of the at least one thermoelectric chip thereby allowing current to continue flowing through the at least one thermoelectric chip and maintaining the cold side of the at least one thermoelectric chip in a cold state sufficient to continue cooling the water receptacle, and (B) the fan pulls the collected heat away from the heat sink to cool the heat sink thereby allowing the heat sink to continue collecting heat from the hot side of the at least one thermoelectric chip.

2. A method of manufacturing a thermoelectric cooling unit for bottled water dispensing systems as claimed in claim 1 wherein the water receptacle is ceramic.

3. A method of manufacturing a thermoelectric cooling unit for bottled water dispensing systems as claimed in claim 1 wherein the water receptacle is plastic.

4. A method of manufacturing a thermoelectric cooling unit for bottled water dispensing systems as claimed in claim 1 wherein the heat sink base plate is copper.

5. A method of manufacturing a thermoelectric cooling unit for bottled water dispensing systems as claimed in claim 1 wherein the plurality of fins have a corrugated configuration.

6. A method of manufacturing a thermoelectric cooling unit for bottled water dispensing systems as claimed in claim 1 wherein the bonding process for bonding the at least one thermoelectric chip to the second side of the base plate consists of soldering.

7. A method of manufacturing a thermoelectric cooling unit for bottled water dispensing systems as claimed in claim 1 wherein two thermoelectric chips are bonded to the second side of the base plate.

8. A method of manufacturing a thermoelectric cooling unit for bottled water dispensing systems as claimed in claim 1 further including the step of clamping the heat sink to the water receptacle, the heat sink having the at least one thermoelectric chip bonded thereto, to assure direct continued contact between the cold side of the at least one thermoelectric chip and the water receptacle.

9. A method of manufacturing a thermoelectric cooling unit for bottled water dispensing systems as claimed in claim 1 wherein the power supply is capable of converting 110 volts alternating current to 12 volts direct current.

10. A bottled water supply cooling unit, comprising:

a bottled water dispensing system including, a hollow housing having a top portion and a bottom portion and defining a first aperture in the top portion;

a water bottle containing water and having an opening insertable within the first aperture of the housing, a water receptacle positioned within the hollow housing and defining a second aperture corresponding to the first aperture, and a water release means attached to the water receptacle, whereby the opening of the water bottle is insertable in the first aperture of the housing such that the opening extends through the second aperture of the water receptacle so that the water flows from the bottle, through the receptacle, and is released by the water release means;

a heat sink including a base plate, the base plate having a first side and a second side, and the heat sink further including a plurality of fins bonded to and extending outwardly from the first side of the base plate;

at least one thermoelectric chip bonded, using a bonding process, to the second side of the base plate wherein the at least one thermoelectric chip has a cold side which is in direct contact with the water receptacle to lower the temperature of the water contained within and flowing through the water receptacle and further has a hot side which is in direct contact with the heat sink, wherein the base plate is located between the at least one thermoelectric chip and the plurality of fins;

a power supply capable of providing a current through the at least one thermoelectric chip; and a fan, whereby (A) the heat sink collects heat from the hot side of the at least one thermoelectric chip thereby allowing current to continue flowing through the at least one thermoelectric chip and maintaining the cold side of the at least one thermoelectric chip in a cold state sufficient to continue cooling the water contained within and flowing through the water receptacle, and (B) the fan pulls the collected heat away from the heat sink to cool the heat sink thereby allowing the heat sink to continue collecting heat from the hot side of the at least one thermoelectric chip.

11. A bottled water supply cooling unit as claimed in claim 10 wherein the water receptacle is ceramic.

12. A bottled water supply cooling unit as claimed in claim 10 wherein the water receptacle is plastic.

13. A bottled water supply cooling unit as claimed in claim 10 wherein the heat sink base plate is copper.

14. A bottled water supply cooling unit as claimed in claim 10 wherein the plurality of fins have a corrugated configuration.

15. A bottled water supply cooling unit as claimed in claim 10 wherein the bonding process for bonding the at least one thermoelectric chip to the second side of the base plate consists of soldering.

16. A bottled water supply cooling unit as claimed in claim 10 wherein two thermoelectric chips are bonded to the second side of the base plate.

17. A bottled water supply cooling unit as claimed in claim 10 further comprising clamping means for clamping the heat sink to the water receptacle, the heat sink having the at least one thermoelectric chip bonded thereto, to assure direct continued contact between the cold side of the at least one thermoelectric chip and the water receptacle.

18. A bottled water supply cooling unit as claimed in claim 10 wherein the power supply is capable of converting 110 volts alternating current to 12 volts direct current.

* * * * *